US008267331B2

(12) United States Patent
Seabase et al.

(10) Patent No.: US 8,267,331 B2
(45) Date of Patent: Sep. 18, 2012

(54) SPRAYER AND MEDIA CARTRIDGE THEREFOR

(75) Inventors: Peter P. Seabase, Cuyahoga Falls, OH (US); Thomas K. Milo, Akron, OH (US); Gordon R. Schorr, Uniontown, OH (US)

(73) Assignee: Akron Device Technologies, LLC, Akron, OH (US)

( * ) Notice: Subject to any disclaimer, the term of this patent is extended or adjusted under 35 U.S.C. 154(b) by 543 days.

(21) Appl. No.: 12/502,577

(22) Filed: Jul. 14, 2009

(65) Prior Publication Data

US 2010/0006671 A1 Jan. 14, 2010

Related U.S. Application Data

(60) Provisional application No. 61/080,406, filed on Jul. 14, 2008.

(51) Int. Cl.
*B05B 9/04* (2006.01)

(52) U.S. Cl. ..... 239/332; 239/337

(58) Field of Classification Search ..... 239/332, 239/320, 322, 323, 327, 328, 329, 333, 349, 239/351

See application file for complete search history.

(56) References Cited

U.S. PATENT DOCUMENTS

| | | | | |
|---|---|---|---|---|
| 1,191,751 | A | 1/1916 | Walkup | |
| 1,992,426 | A | 2/1935 | Herbsman | 299/89 |
| 2,240,401 | A | 4/1941 | Jordan | 299/88 |
| 3,565,344 | A | 2/1971 | Takei | 239/332 |
| 4,187,959 | A | 2/1980 | Pelton | 222/94 |
| 4,251,032 | A * | 2/1981 | Werding | 239/323 |
| 4,393,993 | A | 7/1983 | Kille | 239/332 |
| 4,628,644 | A | 12/1986 | Somers | 51/427 |
| 4,834,286 | A | 5/1989 | Sulz | 239/124 |
| 5,150,841 | A | 9/1992 | Silvenis | 239/332 |
| 5,255,852 | A | 10/1993 | Morrison | 239/346 |
| 5,409,024 | A | 4/1995 | Morrison | 134/104.2 |
| 5,622,283 | A | 4/1997 | Morrison | 222/103 |
| 5,683,013 | A | 11/1997 | Morrison | 222/103 |
| 5,842,646 | A | 12/1998 | Kitayima | 239/345 |
| 5,845,812 | A | 12/1998 | Morrison | 222/83 |
| 6,168,093 | B1 | 1/2001 | Greer | 239/332 |
| 6,241,132 | B1 | 6/2001 | Morrison | 222/541.6 |
| 6,394,365 | B1 * | 5/2002 | Jeanfreau | 239/373 |
| 6,502,766 | B1 | 1/2003 | Streutker | 239/332 |
| 6,568,604 | B1 * | 5/2003 | Behan et al. | 239/314 |
| 6,715,643 | B1 * | 4/2004 | Kelly | 222/82 |
| 6,820,824 | B1 | 11/2004 | Joseph | 239/346 |
| 6,892,960 | B2 | 5/2005 | Ptak | 239/398 |
| 7,066,406 | B2 | 6/2006 | Williams | 239/375 |
| 7,090,149 | B2 | 8/2006 | Federov | 239/346 |
| 7,338,557 | B1 * | 3/2008 | Chen et al. | 118/300 |
| 2007/0102541 | A1 * | 5/2007 | MacLean-Blevins | 239/313 |

* cited by examiner

*Primary Examiner* — Davis Hwu
(74) *Attorney, Agent, or Firm* — Alvin T. Rockhill

(57) ABSTRACT

The subject invention relates to a power sprayer that offers flexibility of movement because it can be battery operated and is designed to eliminate the need for cleaning its spray nozzle after being used. Paint colors can be changed quickly by simply changing the media cartridges that are adapted for simple attachment to the sprayer. These media cartridges also eliminate the inconvenience associated with refilling conventional power sprayers with a desired media. The present invention more specifically discloses a sprayer media cartridge system comprising: (a) a media container, (b) a self-cleaning nozzle, (c) a media shut-off means, (d) a primary media atomizing aperture in a configuration relative to the self-cleaning nozzle, (e) a movable media containment member within the media container, (f) a gas transfer interface, and (g) a power unit engagement means.

19 Claims, 17 Drawing Sheets

51
52
56
50
9
3
53
2
1
20
24
54

SPRAYER AND MEDIA CARTRIDGE THEREFOR

This application claims benefit of U.S. Provisional Patent Application Ser. No. 61/080,406, filed on Jul. 14, 2008. The teachings of U.S. Provisional Patent Application Ser. No. 61/080,406 are incorporated herein by reference in their entirety.

BACKGROUND OF THE INVENTION

A wide variety of consumer products are frequently packaged in aerosol cans. These products include paints, hair spray, insecticides, herbicides, air fresheners, perfumes, fragrances, antimicrobial agents, cleaners, anti-sticking agents, and the like. Even though packaging these types of products in aerosol cans has been well accepted by consumers for decades, the continued use of aerosol cans for packaging consumer products is coming under greater and greater scrutiny. Most of the criticism relating to the use of aerosol cans originates from the thesis that aerosols are harmful to the environment. Additionally, the aerosol cans themselves are typically discarded after being used and generally end up in landfills as solid waste. In actual practice the steel of which aerosol cans are made is seldom recycled.

Aerosol cans also have the drawback of potentially exploding and causing personal injury and/or property damage if they are exposed to high temperatures during storage or transportation. This danger of explosion limits the manner in which products that are packaged in aerosol cans are transported, stored, and utilized.

Power sprayers that can be used to apply liquid compositions, such as paints, insecticides, lubricants, and the like to substrates are a viable alternative to aerosols. In fact, power sprayers circumvent many of the problems associated with the use of aerosols. For instance, the use of power sprayers does not present the explosion hazard or the environmental concerns associated with aerosol products. However, power sprayers are frequently awkward to handle and difficult to clean after being used.

SUMMARY OF THE INVENTION

The subject invention relates to a power sprayer that can be conveniently used by both professionals and amateurs. This power sprayer offers flexibility of movement because it can be battery operated. It also is designed to eliminate the need for cleaning its spray nozzle after being used. The media being sprayed can also be easily changed quickly and easily. For instance, paint colors can be changed quickly and repeatedly by simply changing the media cartridges that are adapted for simple attachment to the sprayer. The media cartridges used in conjunction with the sprayers of this invention also eliminate the inconvenience associated with refilling conventional power sprayers with a desired media. Even more importantly, it eliminates the need for extensive clean-up and cleaning materials, such as solvents, rags, paper towels, etc., which is time-consuming and has a negative impact on the environment. One of the most important benefits of the present invention is the ability to deliver virtually any media, including waterborne systems, without compromising the spray quality and flexibility of a spray can. In fact, the power sprayer of this invention offer even better flexibility than conventional sprayers or spray cans by virtue of being capable of being used while in any orientation.

The present invention more specifically discloses a media cartridge system for a sprayer comprising: (a) a media container, (b) a self-cleaning nozzle, (c) a media shut-off means, (d) a primary media atomizing aperture in a configuration relative to the self-cleaning nozzle, (e) a movable media containment member within the media container, (f) a gas transfer interface, and (g) a power unit engagement means.

The subject invention further discloses a sprayer which is comprised of (1) an electrical power source, (2) an electric motor, (3) a pump which is driven by the motor, (4) an output, (5) an electrical control switch, (6) a media cartridge air transfer interface, (7) a media cartridge engagement means, and (8) a media cartridge which is comprised of (a) a media container, (b) a self-cleaning nozzle, (c) a media shut-off means, (d) a primary media atomizing aperture in a configuration relative to the self-cleaning nozzle, (e) a movable media containment member within the media container, (f) a gas transfer interface, and (g) a power unit engagement means.

The present invention also reveals a sprayer which is comprised of (1) a power unit which includes (a) an electrical power source, (b) an electric motor, (c) a pump which is driven by the motor, (d) an output control, and (e) an electrical control switch, (2) a nozzle unit which includes (a) a media cartridge air transfer interface, (b) a power unit engagement means, (c) a gas transfer interface, and (3) a media container wherein the media container includes (a) a media cartridge engagement means, (b) a movable media containment member within the media container, (c) a media container air transfer interface and (d) a media supply line interface.

The subject invention further discloses a sprayer having a configuration which comprises a media outlet, a storage device/energy source (such as a capacitor, a fuel cell or a battery), at least one primary atomization outlet, and at least one spray pattern shaping/secondary outlet that minimizes power usage, wherein the primary outlet utilizes higher pressure than the secondary outlet, wherein the higher pressure utilized by the primary outlet is at least 2 times the pressure of the pressure utilized by the secondary outlet and wherein the primary atomization aperture is configured in a convex shape relative to the media aperture to provide enhanced self-cleaning as well as increased gas flow by entrainment of ambient gases through a coanda effect. The objective of this sprayer system is to deliver and shape a higher level of media at the same level of power consumption as compared to conventional spraying technology. This is accomplished by separating the need for high energy atomization air flow from the lower pressure needed to attain a desired spray pattern.

BRIEF DESCRIPTION OF THE DRAWINGS

FIG. 10 illustrates both a vertical flat pattern 61 and a horizontal flat pattern 62 either of which can be attained via appropriate orientation of the secondary air pattern shaping outlet port 40.

FIG. 11 depicts a shut media nozzle 63 before and after spraying occurs and further depicts an open media nozzle 64 utilized to attain a round spray pattern 65.

REFERENCE NUMERALS USED IN FIGURES

Figure 1:
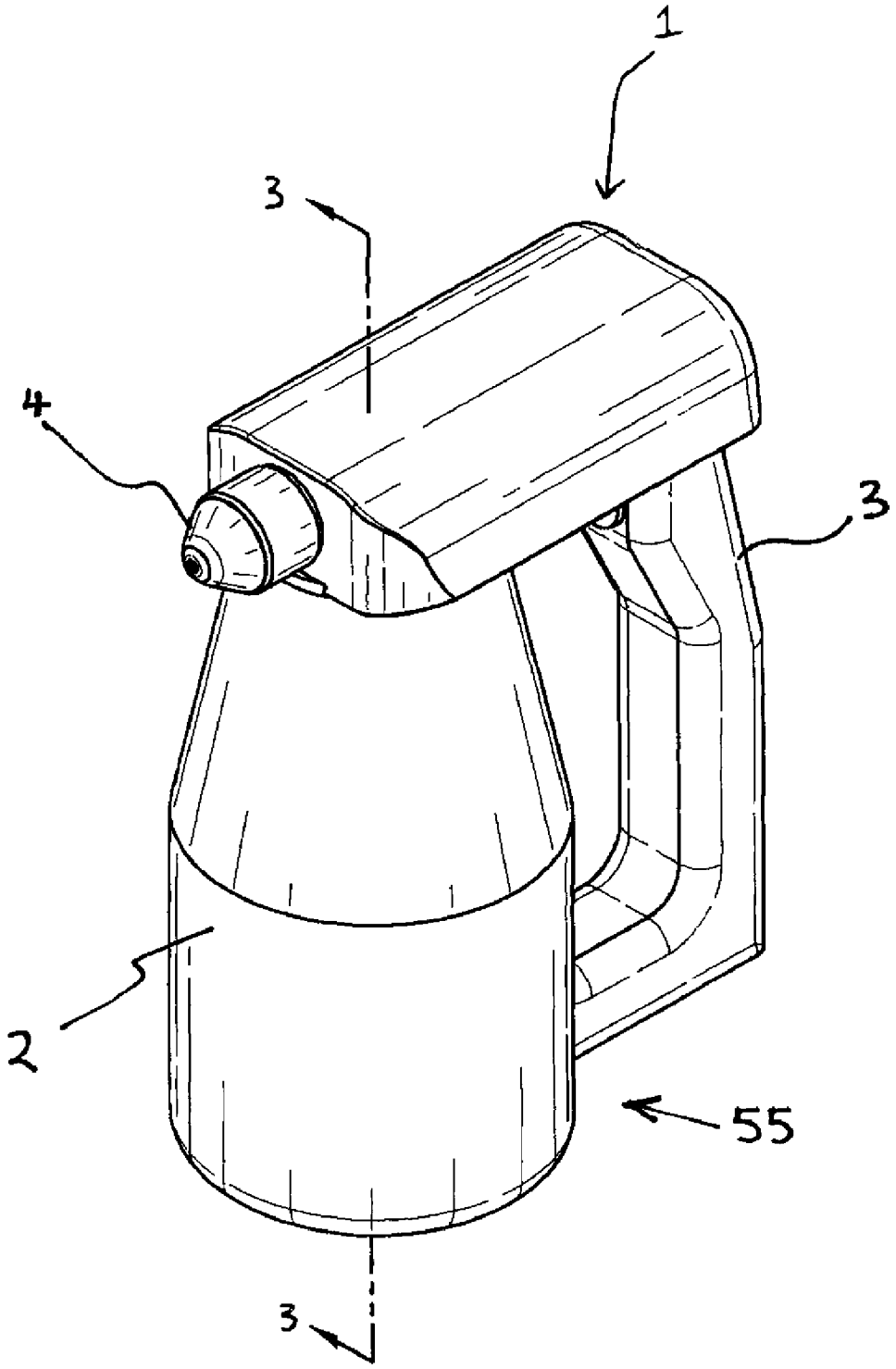
FIG. 1 is a perspective view of a power sprayer of this invention.

The reference numerals used in the drawings to identify various parts or elements of the power sprayer and media cartridge used in the practice of this invention are as follows:

1. media cartridge
2. power unit
3. power unit handle
4. nozzle
5. flexible bladder (moveable media containment member)
6. media container
7. agitation sphere (media preparation device)
8. trigger
9. batteries (electrical power source)
10. electric motor
11. gear train
12. pump
13. constant output control
14. power unit gas transfer line
15. media cartridge (air) gas transfer interface
16. electromechanical vibrator
17. acoustical plate
18. electromagnetic drive
19. power unit engagement means
20. power unit mounting bracket
21. power unit gas transfer interface (gas transfer interface)
22. control switch (electrical)
23. media flow control means
24. tip guard
25. air inlet
26. secondary air blower
27. primary air aperture (primary media atomizing aperture)
28. media aperture
29. media needle (media shut-off means)
30. mechanical interference
31. mechanical interference seat
32. shut-off spring
33. media supply valving needle
34. diaphragm
35. secondary air supply
36. bladder (movable media containment member)
37. media
38. access port
39. seals
40. secondary air pattern shaping outlet port
41. secondary air outlet
42. convex nozzle tip
43. media nozzle tip
44. trigger/nozzle engagement member
45. spray pattern
46. atomized media
47. secondary air
48. primary atomization air
49. pattern shaping air
50. wand
51. handle
52. wand trigger
53. pivot arm
54. wheel
55. power sprayer
56. wand sprayer
57. media cartridge engagement means
58. power unit identification means
59. piston
60. bellows
61. vertical flat pattern
62. horizontal flat pattern
63. shut media nozzle
64. open media nozzle
65. round spray pattern
66. nozzle and power unit interface
67. external media supply connector
68. air bladder
69. external media container

DETAILED DESCRIPTION OF THE INVENTION

The power sprayers of this invention can be made utilizing a wide variety of designs wherein the power unit and media cartridge can be of a variety of different shapes and orientations to each other. FIG. 1 depicts one typical design for such a power sprayer 55. As can be seen, the power sprayer depicted in FIG. 1 includes a media cartridge 1 which attaches to the top of a power unit 2. This sprayer includes a power unit handle 3 which connects the power unit 2 to the media cartridge 1. The media cartridge includes a nozzle 4 which extends forwardly from the media cartridge 1.

Figure 2:
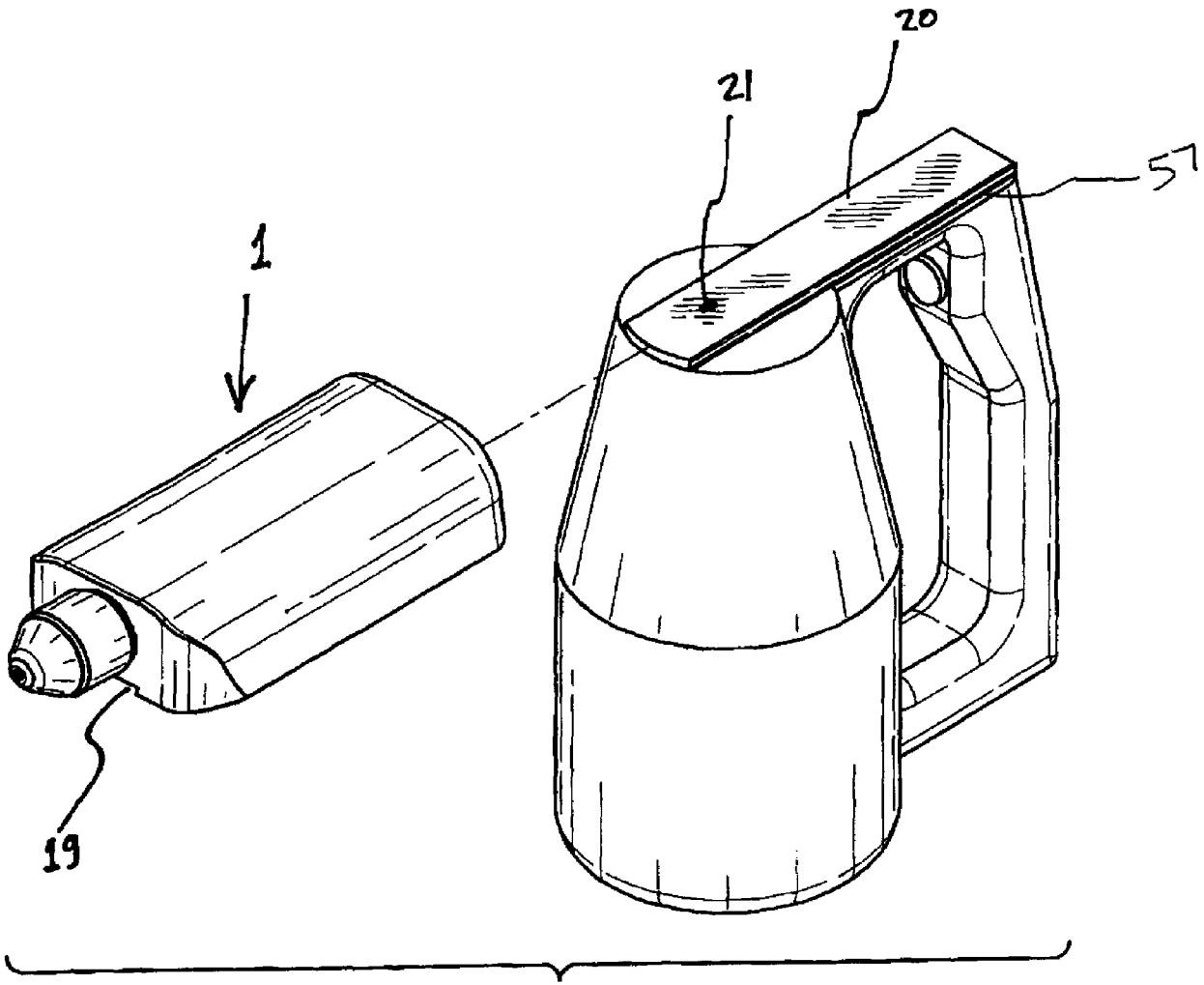
FIG. 2 is a partial exploded view of the power sprayer depicted in FIG. 1 showing the media cartridge detached from the power unit.

FIG. 2 depicts the power sprayer of FIG. 1 wherein the media cartridge 1 is disengaged from the power unit 2. The media cartridge can be affixed to the power unit via the power unit mounting bracket 20 to which the power unit engagement means 19 attaches. In the design shown, this attachment is effectuated by the interlocking edges which taper in one direction to engage the media cartridge to the power unit at the desired orientation. In this orientation, the power unit gas transfer interface 21 which is a port that aligns with a media cartridge gas transfer interface 15 (as shown in FIG. 3).

Figure 3:
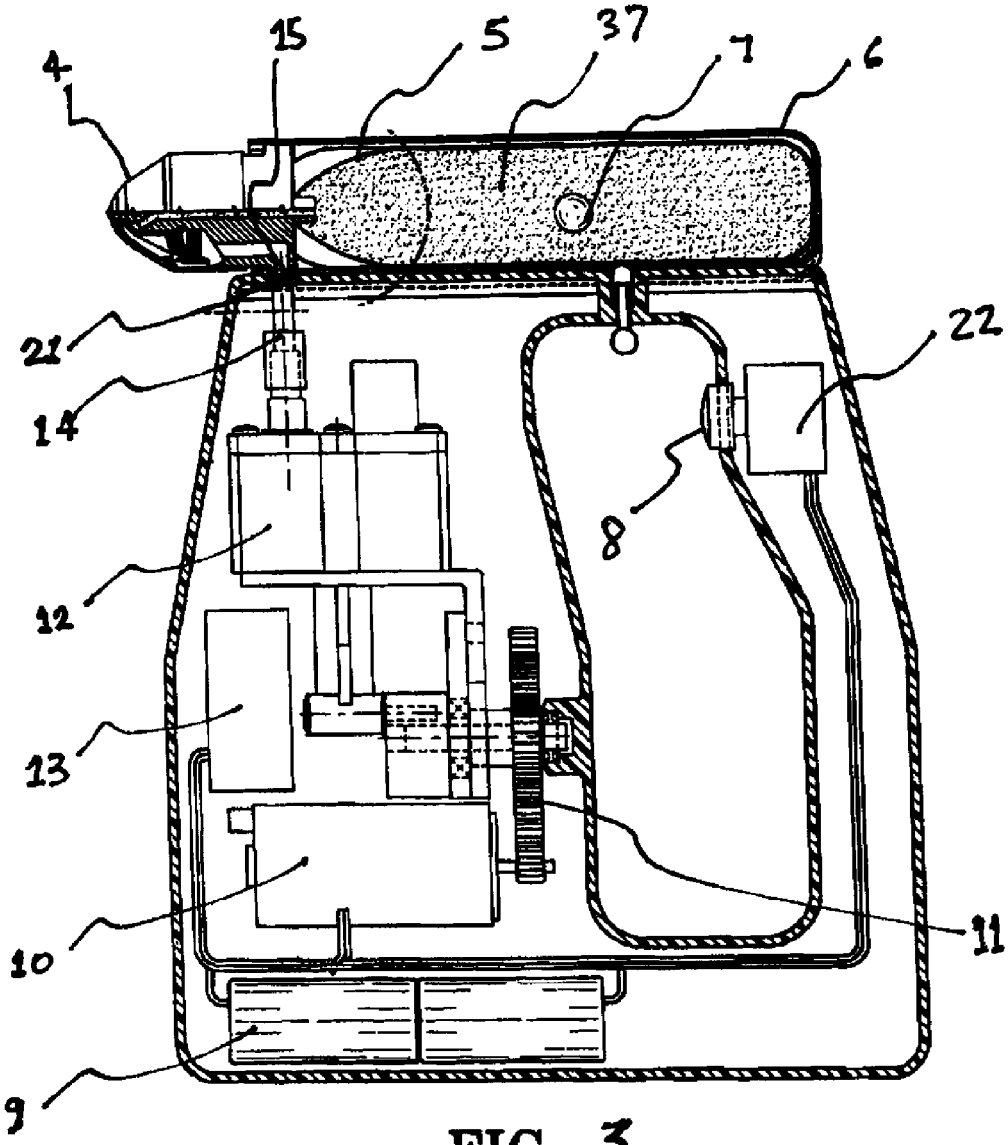
FIG. 3 is a cross-sectional view of the power sprayer depicted in FIG. 1 as cut along section line 3-3.

FIG. 3 is a cross-sectional view of the power sprayer of FIG. 1 showing the media cartridge affixed to the power unit. As can be seen, the media cartridge includes a media container 6 which is filled with media 37. In cases where the media is a liquid it is highly preferred from the movable media containment member to be essentially free of gases. In any case, the media is contained in the media container 6 with a movable media containment member 5. The media container also includes an agitation sphere 7 for preparing the media for application to a substrate by agitating the media to attain a homogeneous mixture. As can be seen, the media cartridge includes a nozzle 4 through which the media passes while being sprayed. The media cartridge also includes a media cartridge gas transfer interface 15 which mates with the power unit gas transfer interface 21 to provide a pressurized gas such as air which provides force to compress the movable media containment member 5 to force the media 37 there from and ultimately out through nozzle 4 into a desired spray pattern.

The gas from the power unit is compressed by pump 12 which is typically powered by an electric motor 10 having an appropriate gear train 11, if necessary. The electric motor is typically powered with DC batteries 9 which provide DC current to the electric motor. This supply of electricity optimally is through an output control 13 which is capable of providing the electric motor with constant voltage to attain consistent motor speed (constant revolutions per minute). In other embodiments of this invention, the output control 13 can be designed to provide variable output motor speed to attain desired spray patterns or can be designed to provide controllable output. For instance, the output of the motor can be automatically set by the device to attain a desirable spray pattern predicated upon the distance of the spray nozzle from a substrate surface as could be automatically determined utilizing an infrared, radar, or ultrasonic distance measurement system.

The operation of the unit can be controlled via switch 22 which toggles between an open and closed position via trigger 8 to provide power to the unit as desired. In one embodiment of this invention the switch can be a variable control which will allow the motor to increase or decrease in speed depending upon the degree to which the trigger is pulled. The variable control can be a rheostat, a pot, or any other device capable or providing a variable signal to the output control 13.

Figure 4:
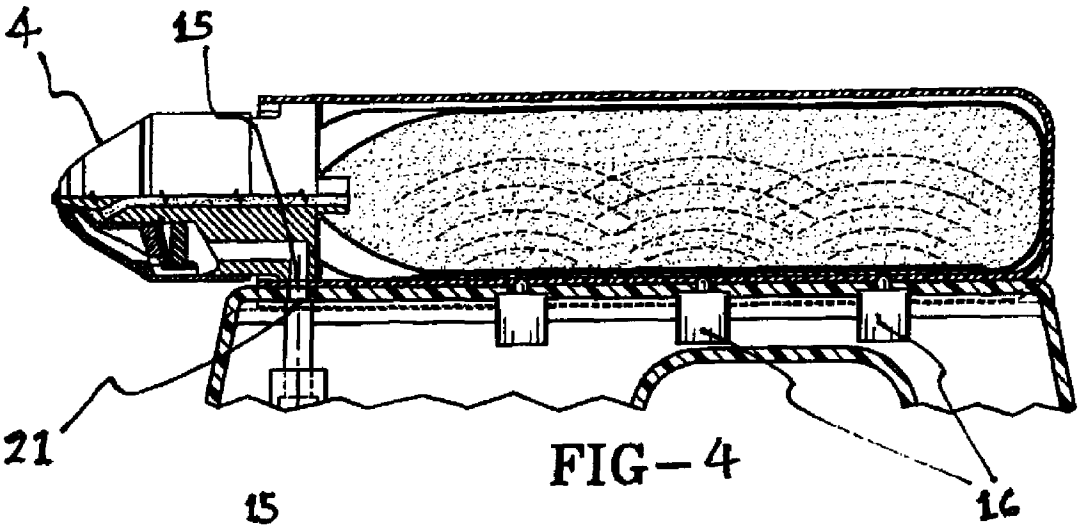
FIG. 4 is a partial section view showing one embodiment of this invention depicting an electromagnetic vibrator for media agitation.
Figure 5:
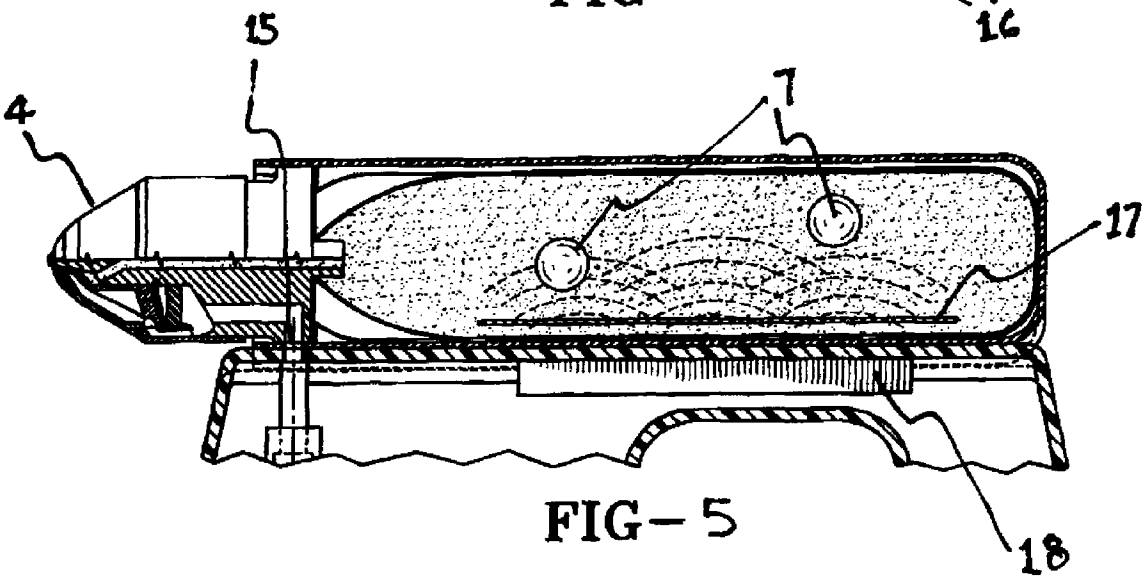
FIG. 5 is a partial section view showing one embodiment of this invention depicting an acoustical/electro-magnetic vibrator for media agitation.

FIG. 4 depicts a media cartridge having a nozzle of convex shape. This device shows an electromechanical vibrator 16 for agitating the media to attain a homogeneous mixture. FIG. 5 also depicts such a media cartridge wherein an acoustical plate 17 or an electromagnetic device 18 is utilized to agitate the media wherein such agitation can optionally be carried out with the aid of an agitation sphere 7. It should be noted that a convex nozzle shape provides enhanced resistance to air nozzle clogging.

Figure 6:
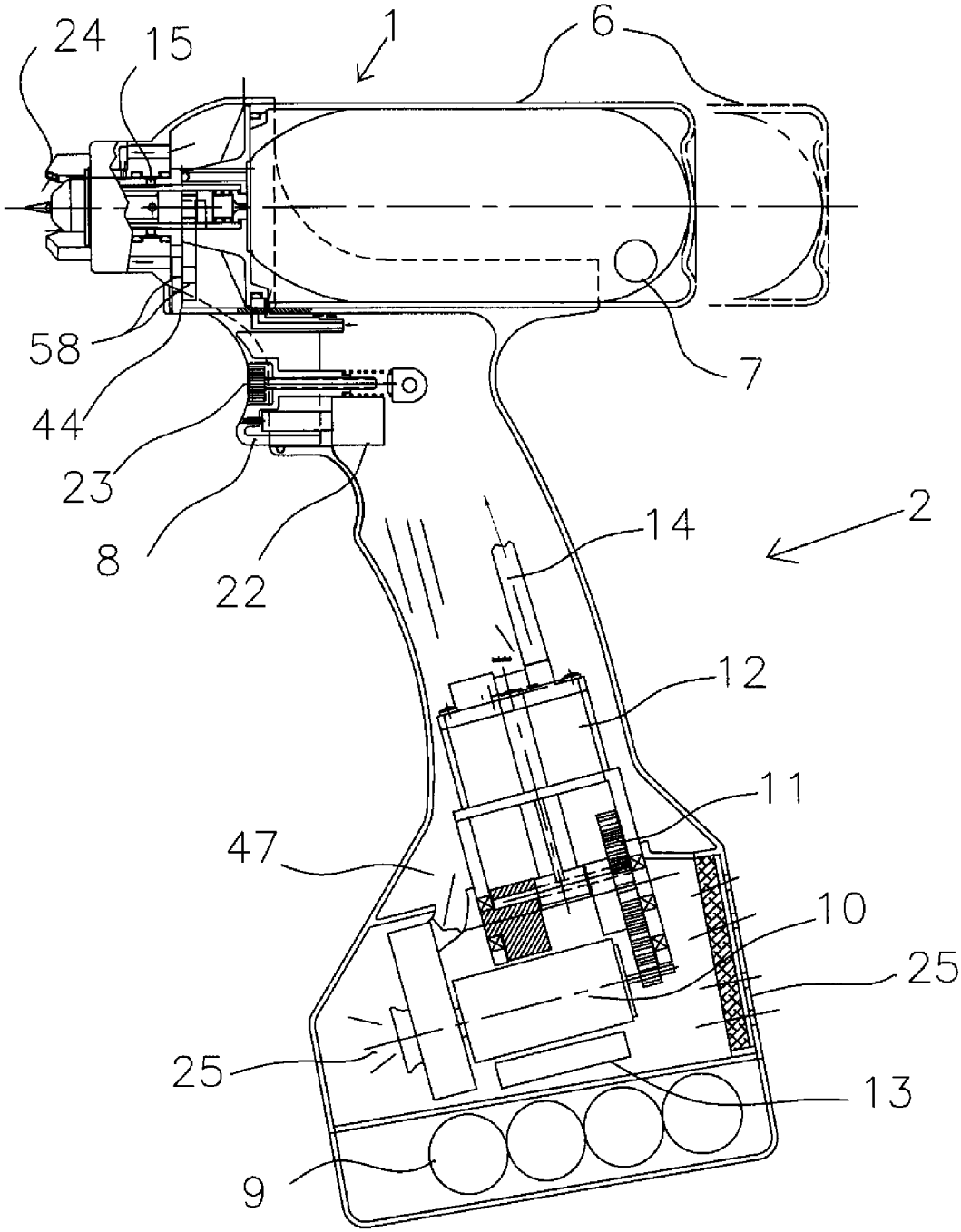
FIG. 6 is a cross-sectional view of another embodiment of the power sprayer of this invention.
Figure 7:
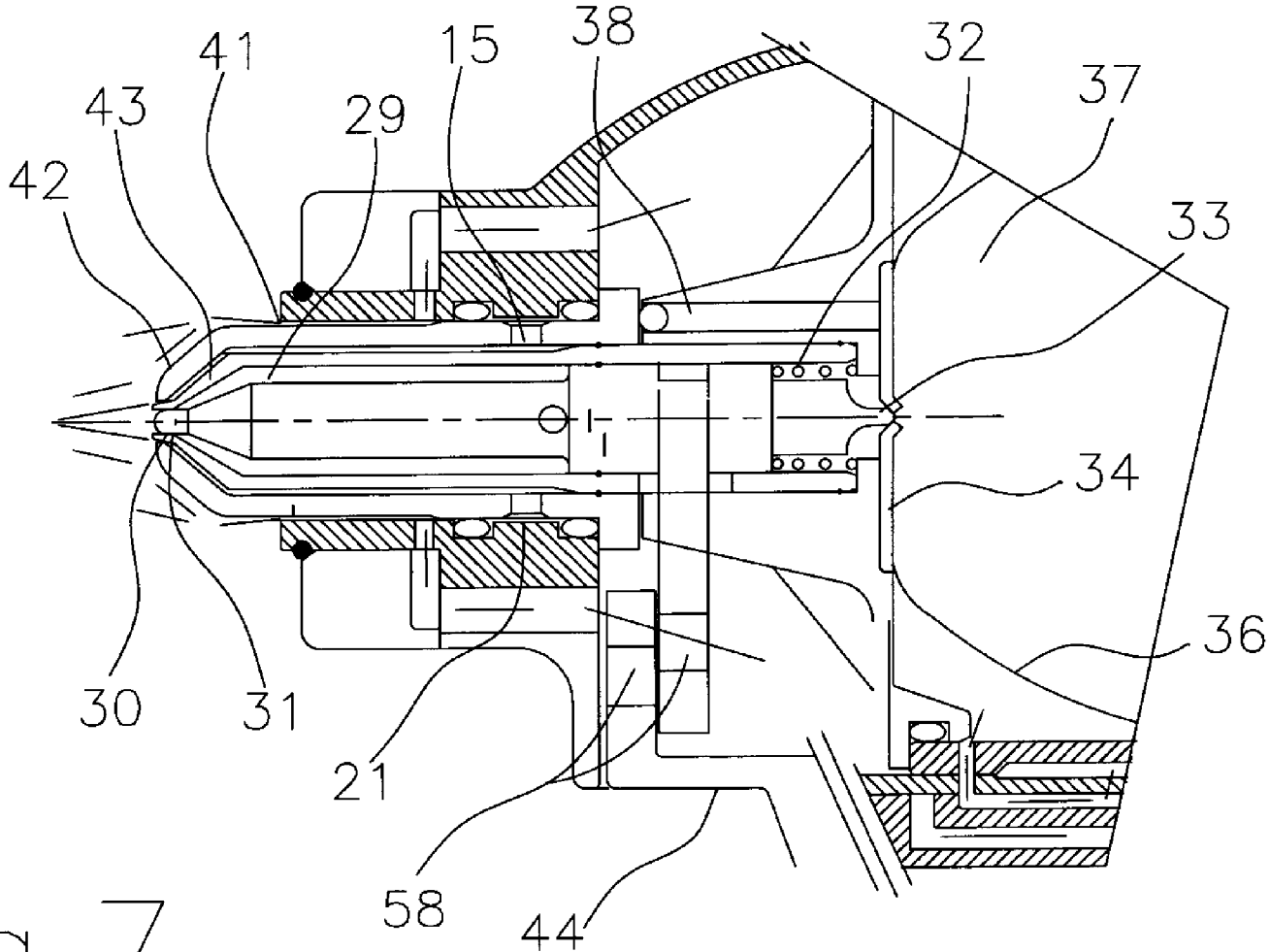
FIG. 7 is a cross-sectional view of the power-sprayer of FIG. 6 highlighting the internal components of the nozzle portion of the media cartridge in a "closed/not spraying" mode.
Figure 8:
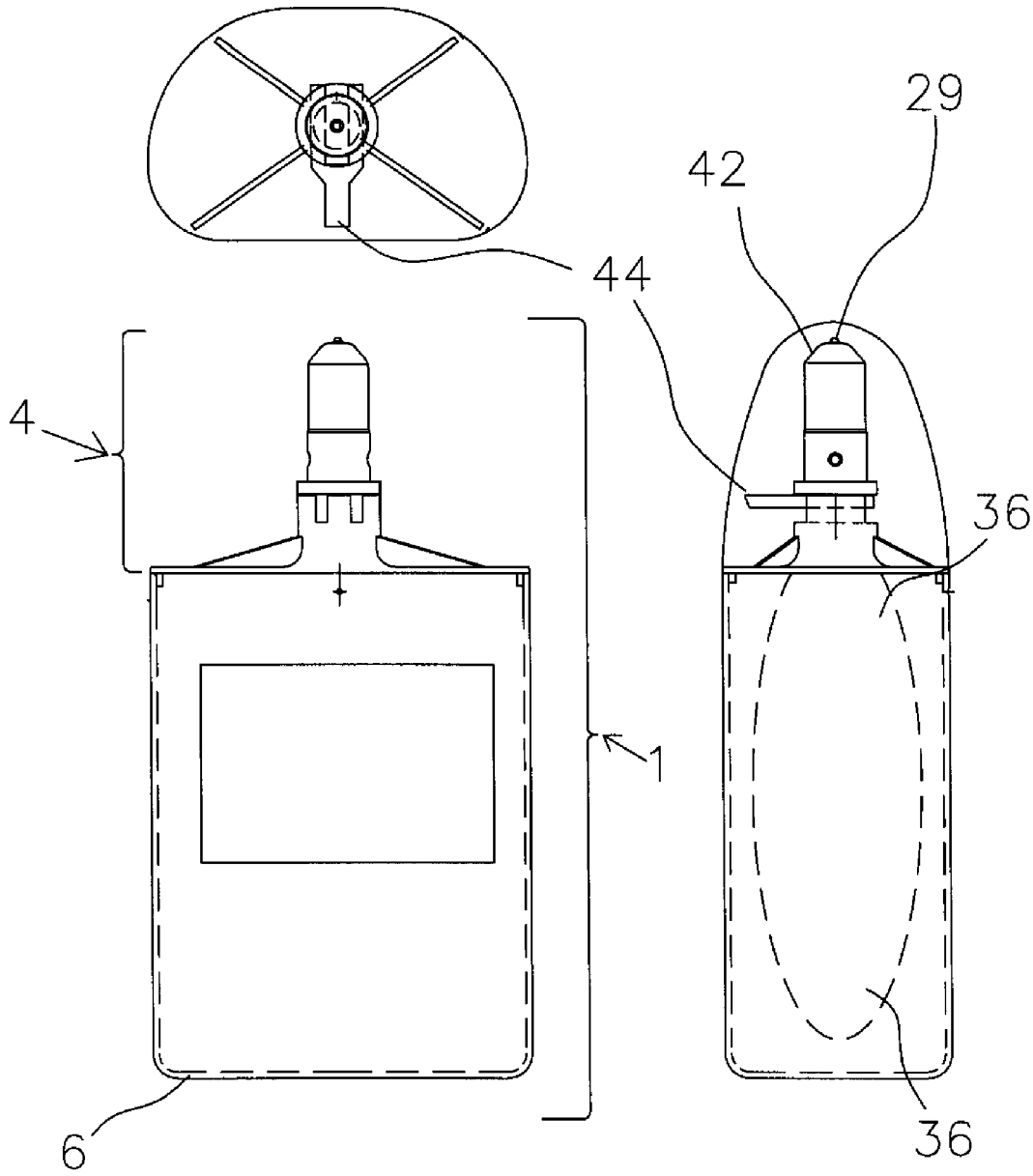
FIG. 8 is an orthographic view of the media cartridge.
Figure 10:
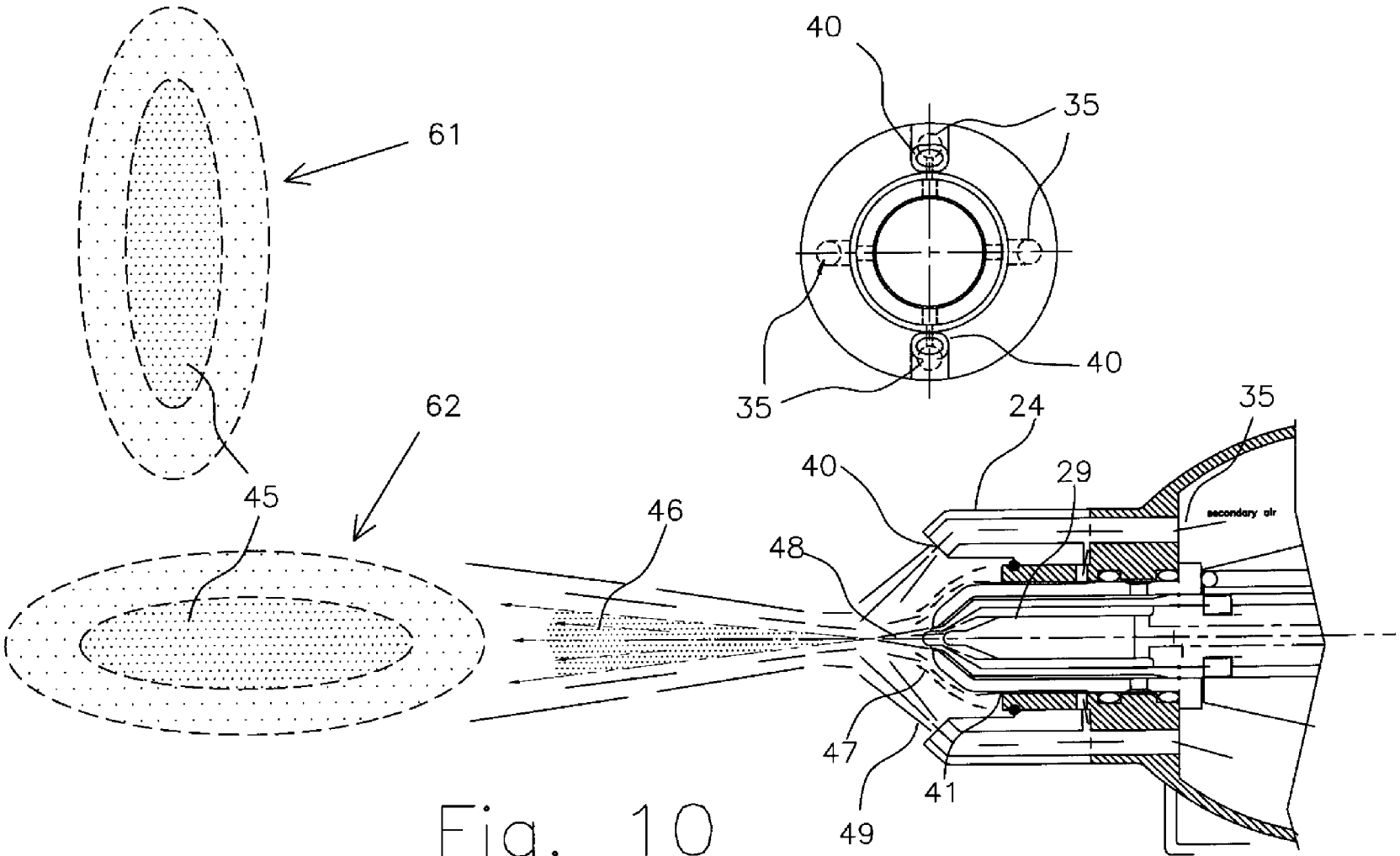
FIG. 10 is a cross-sectional view of the power-sprayer of FIG. 6 highlighting the internal components of the nozzle portion of the media cartridge in an open spraying mode depicting an oval spray pattern that can be attained due to positioning of the tip guard.
Figure 11:
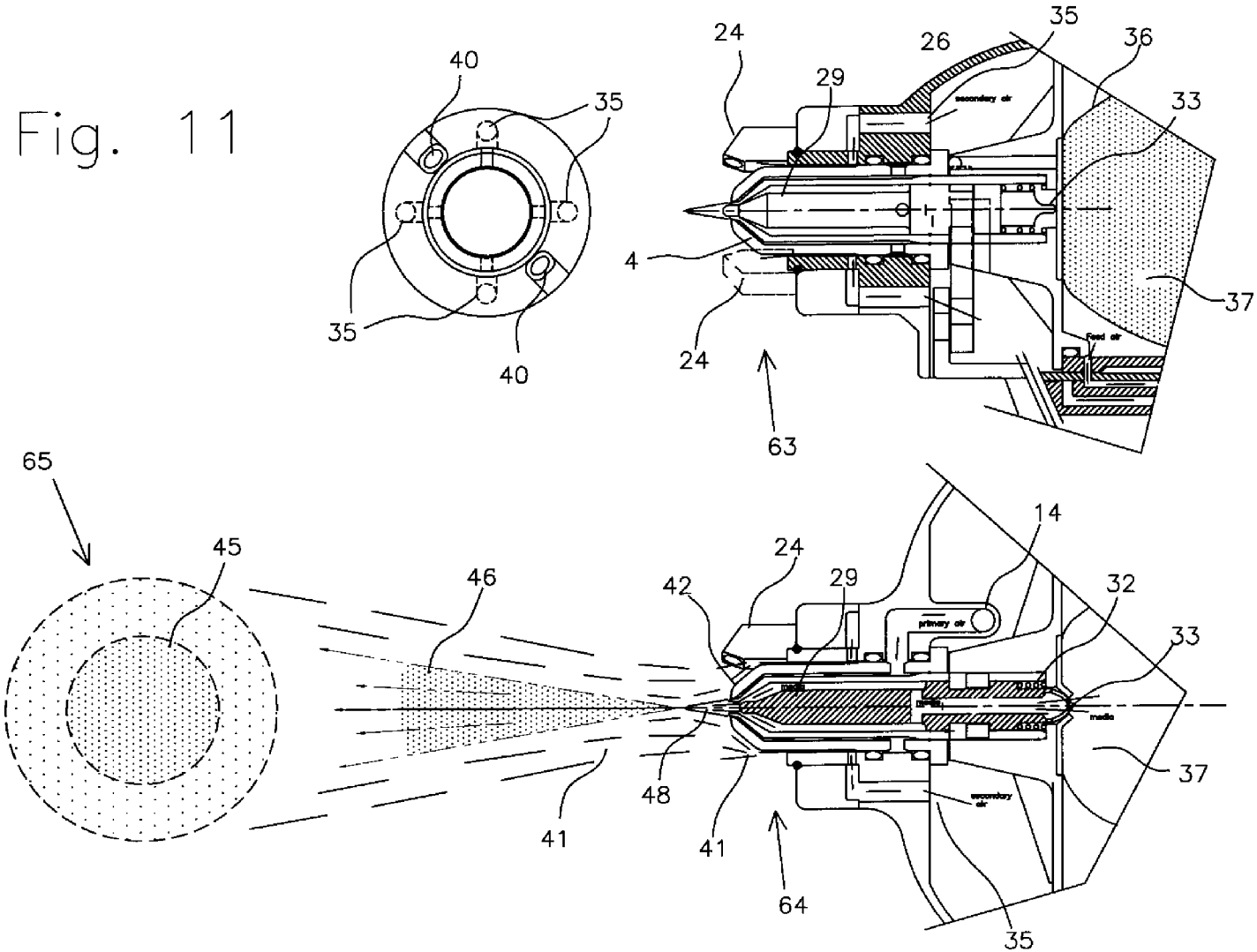
FIG. 11 is a cross-sectional view of the power-sprayer of FIG. 6 highlighting the internal components of the nozzle portion of the media cartridge in an open spraying mode depicting a round spray pattern that can be attained due to positioning of the tip guard.

FIG. 6 depicts another embodiment for a spray gun 55 in accordance with this invention. This design includes a tip guard 24 which protects the tip of the nozzle from damage which could occur during mishaps such as dropping the spray gun which would adversely affect the quality of the spray. In this design, inlet air 25 is drawn in by the power unit 2 by a secondary air blower 26. The inlet air acts to cool the electric motor 10 and the pump 12. The compressed air exiting the secondary air blower moves through the power unit assembly and enters into the media cartridge as depicted in FIG. 7. FIG. 6 shows a trigger 8 which is integrated with a media flow control means 23. The media flow control means can be a valve that limits the gas (air) pressure in the media container 6 to moderate the amount of pressure applied to the bladder 36 in the embodiment of the invention. In an alternative embodiment of this invention the media flow control means 23 can also limit the travel of the trigger to a desired stop point which also limits the travel of the needle 29 to limit the amount of atomized media 46 spray (as shown in FIG. 10 and FIG. 11). In still another embodiment of this invention the trigger is used to control the ratio of media flow to gas (air) flow. The trigger 8 can further be used to operate the control stitch 22 to activate the output control 13 and to attain the desired electric motor 10 operating speed (rpm output) desired. As can be seen in FIG. 6 and FIG. 7, the trigger 8 has a flexible element that engages the trigger/nozzle engagement member 44. In one embodiment of this invention, the trigger/nozzle engagement member 44 is phased to allow the control switch to activate gas flow before media flow. On trigger 8 the media 37 flow can be terminated before gas flow (primary atomization air 48 flow and secondary air 47 flow) is terminated to enhance the self-cleaning feature of the nozzle 4.

The secondary air flows through the nozzle of the media cartridge and is the source of the secondary air supply 35 can change the desired spray pattern and the secondary air supply 35 can result in augmented secondary air 47 through the coanda effect ( as illustrated in FIG. 10 and FIG. 11). The pump provides pressurized air which flows through a power unit gas transfer line 14 through the power unit gas transfer interface 21 (as shown in FIG. 7) and into the media cartridge gas transfer interface 15 and through the nozzle as primary atomizing air 48 and ultimately through the primary air aperture 27 of the nozzle. The primary atomizing air 48 and the secondary air 47 converge to provide an atomized media 46 as shown in FIG. 10 and FIG. 11.

FIG. 7 is a cross-sectional view of the power-sprayer of FIG. 6 highlighting the internal components of the nozzle portion of the media cartridge in a "closed position" depicting the typical resting position of the mechanical interference 30 when the nozzle 4 is not spraying atomized media. In this position the mechanical interference 30 closes the nozzle 4 by moving forward to form a seal by contact with the mechanical interference seat 31. In this position the media supply valve needle 53 is not penetrating through the diaphragm 34 to allow media 37 to flow from the moveable media containment member 5 to the nozzle 4. The power unit identification means 58 can be a mechanical or electrical device that identifies the cartridge and optionally its contents. It typically also adjusts output parameters to attain a desired result. These parameters can include but are not limited to a fine, medium or heavy spray output and coverage or quality. This is accomplished through control by varying the output of the primary and secondary air supplies, motor, pump and/or media output.

Figure 9:
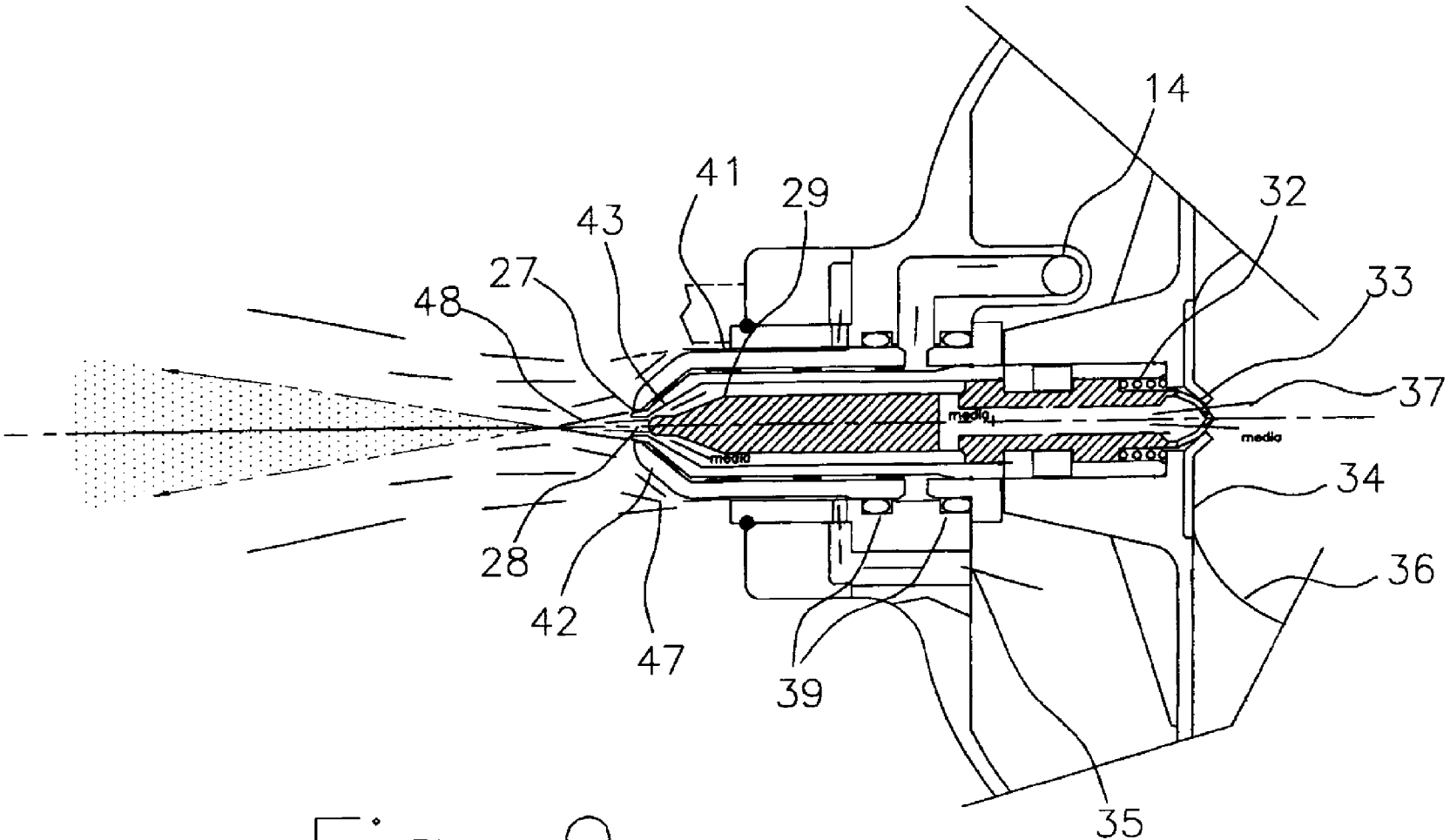
FIG. 9 is a cross-sectional view of the power-sprayer of FIG. 6 highlighting the internal components of the nozzle portion of the media cartridge in an open spraying mode depicting the flow pattern of both the spray media and primary and secondary air.

FIG. 9 is a cross-sectional view of the power-sprayer of FIG. 6 highlighting the internal components of the nozzle portion of the media cartridge in an "open position" depicting the position of the mechanical interference 30 when the nozzle 4 is spraying atomized media. In this position the mechanical interference 30 is pulled back to open the nozzle 4 by to allow media to flow through the media aperture 28. In this open position the media shut off needle is pulled away from the mechanical interference seat 31 to allow media 37 to flow around it and out of the primary aperture 27. In this position the media supply valve needle 53 penetrates through the diaphragm 34 to allow media 37 to flow from the media bladder 36 to the nozzle 4. FIG. 9 also shows the flow pattern of the atomized spray media 46, the primary atomizing air 48, and secondary air 47.

FIG. 10 is a cross-sectional view of the power-sprayer of FIG. 6 highlighting the internal components of the nozzle portion of the media cartridge in an open spraying mode depicting an oval spray pattern that can be attained by appropriate positioning of the tip guard 24. FIG. 11 is a cross-sectional view of the power-sprayer highlighting the internal components of the nozzle portion of the media cartridge in an open spraying mode depicting a round spray pattern that can be attained by positioning the tip guard 24 in a different orientation. As can be seen in FIG. 10 and FIG. 11, the atomized media 46 can be sprayed into a variable and desired spray pattern 45. It should be noted that the gas flow acts to both cause media atomization and media flow. Media flow is caused by a force differential which can be mechanical, vacuum, and/or positive pressure. For instance, a pressure can be applied upon the moveable media containment member 5 to attain an adequate pressure differential to cause the desired level of media flow. FIG. 10 also depicts that secondary air pattern shaping outlet ports 40 cause a convergence of the secondary air supply 35 onto the primary atomization air 48. The pattern shaping air 49 acts in concert with the secondary air 47 to provide the desired spray pattern 45.

Figure 12:
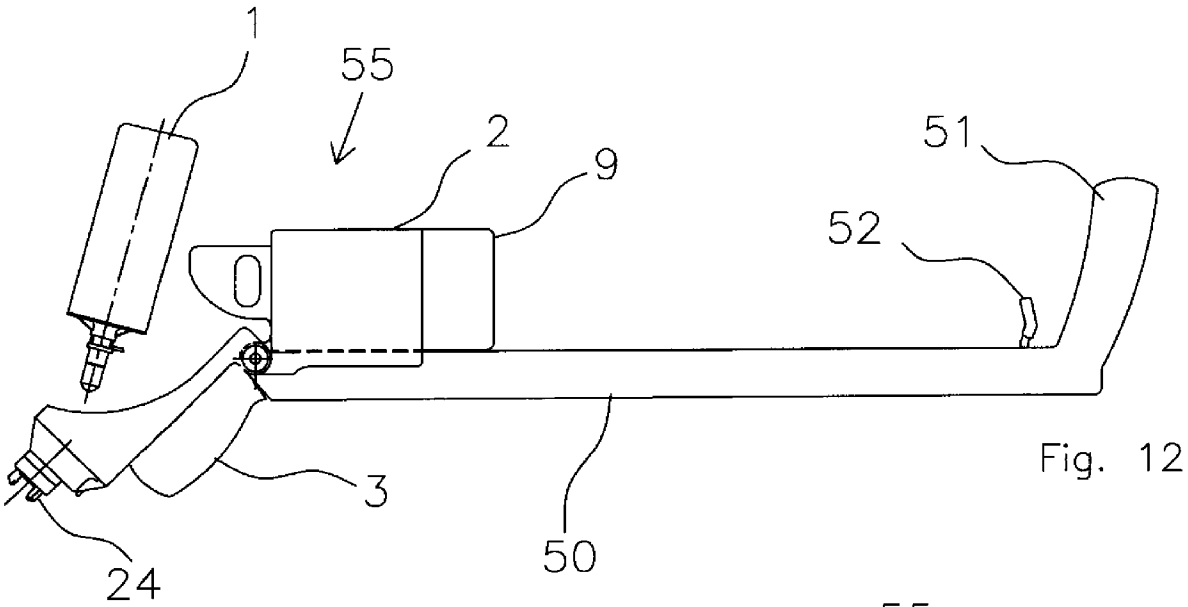
FIG. 12 is a schematic view of another embodiment of the power sprayer of this invention.
Figure 13:
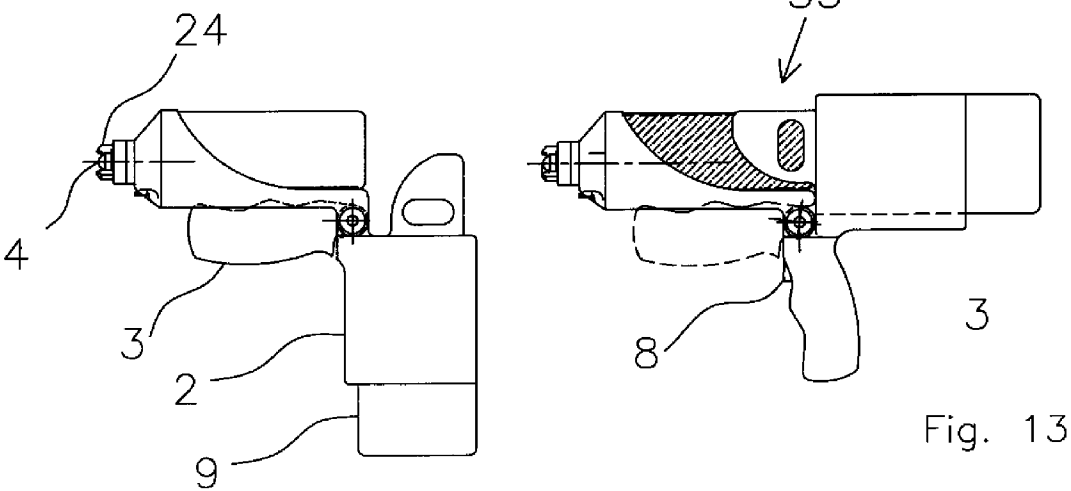
FIG. 13 is a schematic view of another embodiment of the power sprayer of this invention showing a wand hand extension.
Figure 14:
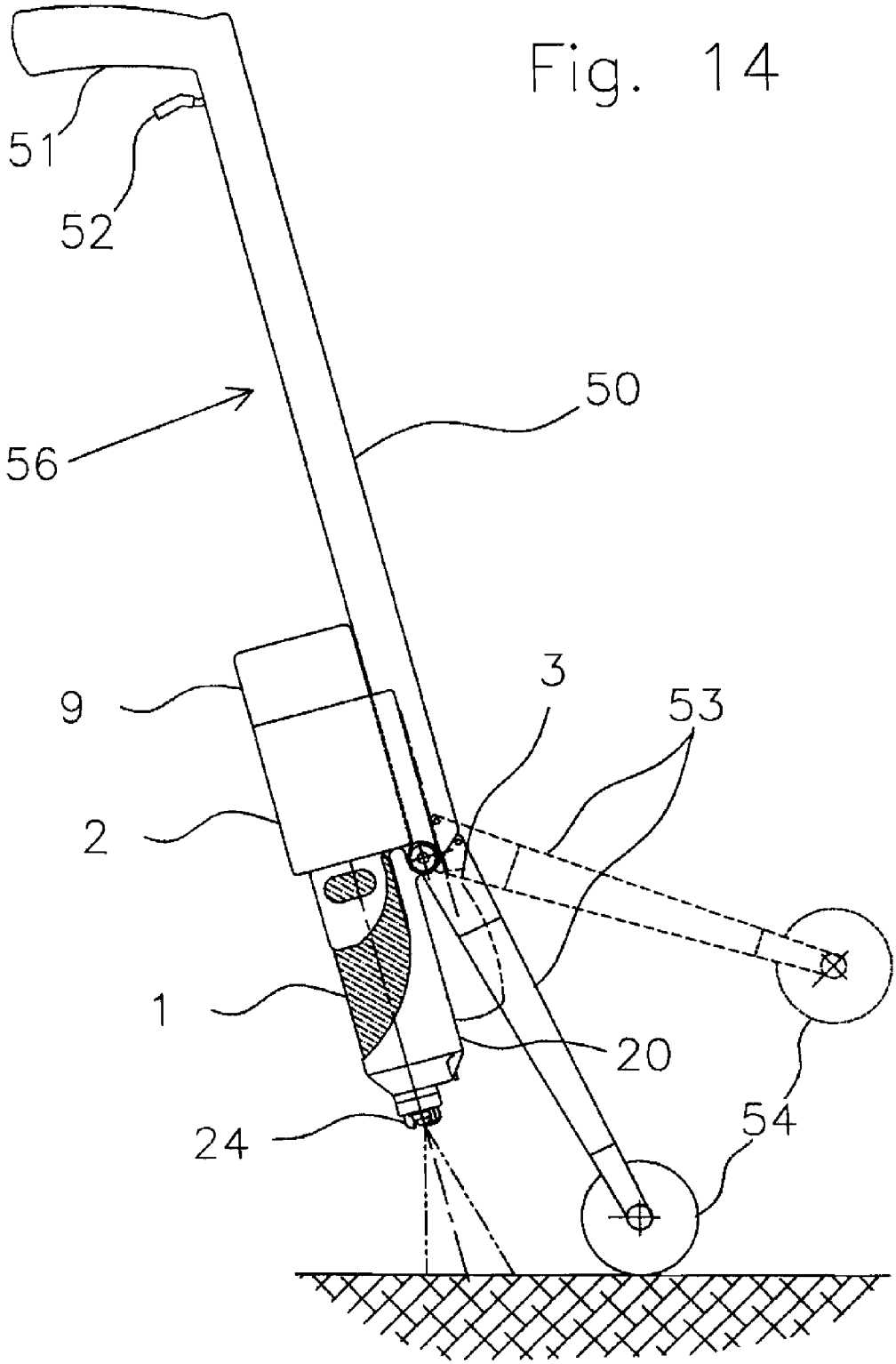
FIG. 14 is a schematic view of the power sprayer of FIG. 13 showing an optional pivot arm with a wheel attachment.
Figure 15:
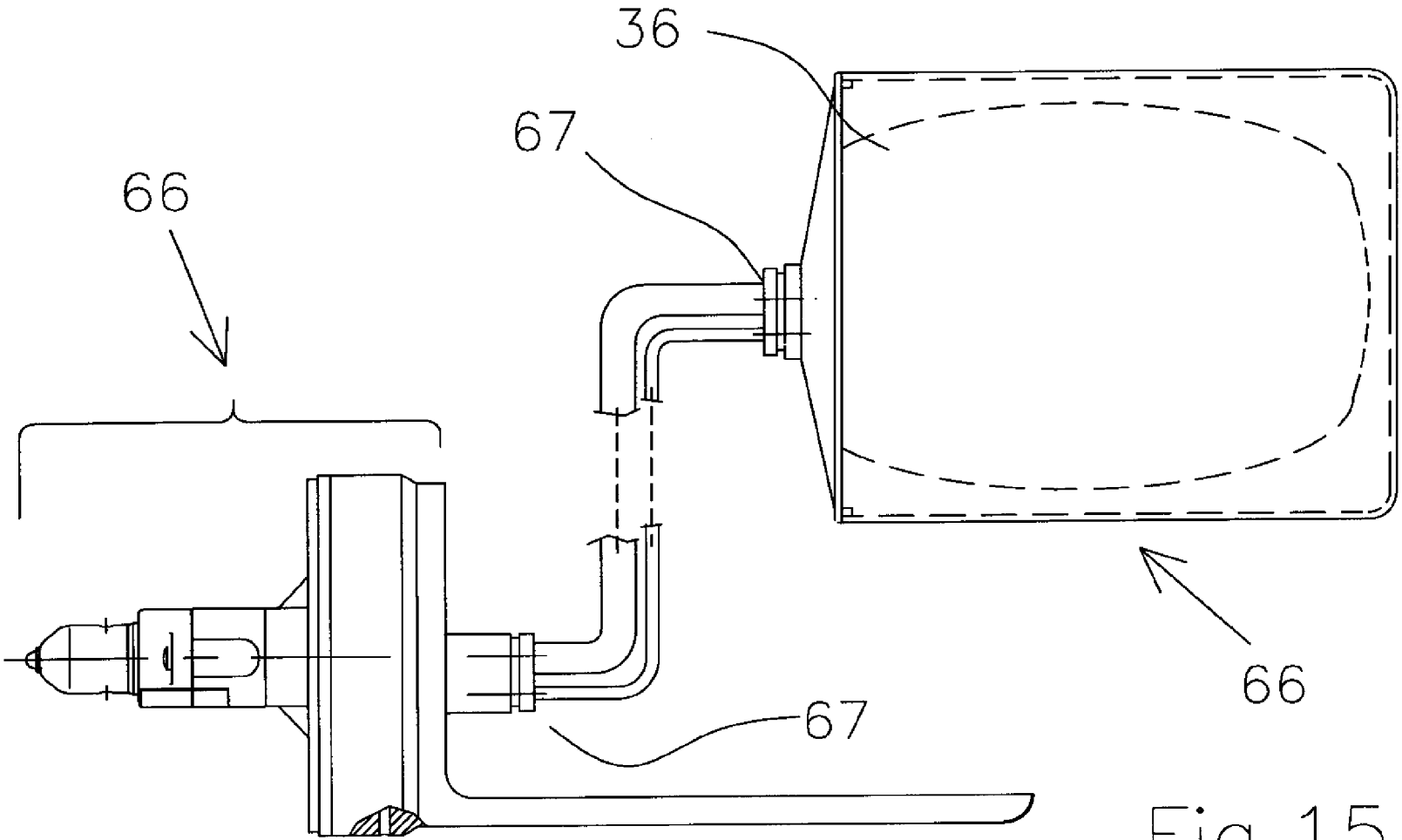
FIG. 15 is a schematic view of a media cartridge adaptor depicting a nozzle and a power unit interface 66 and an external media supply connector 67.
Figure 16:
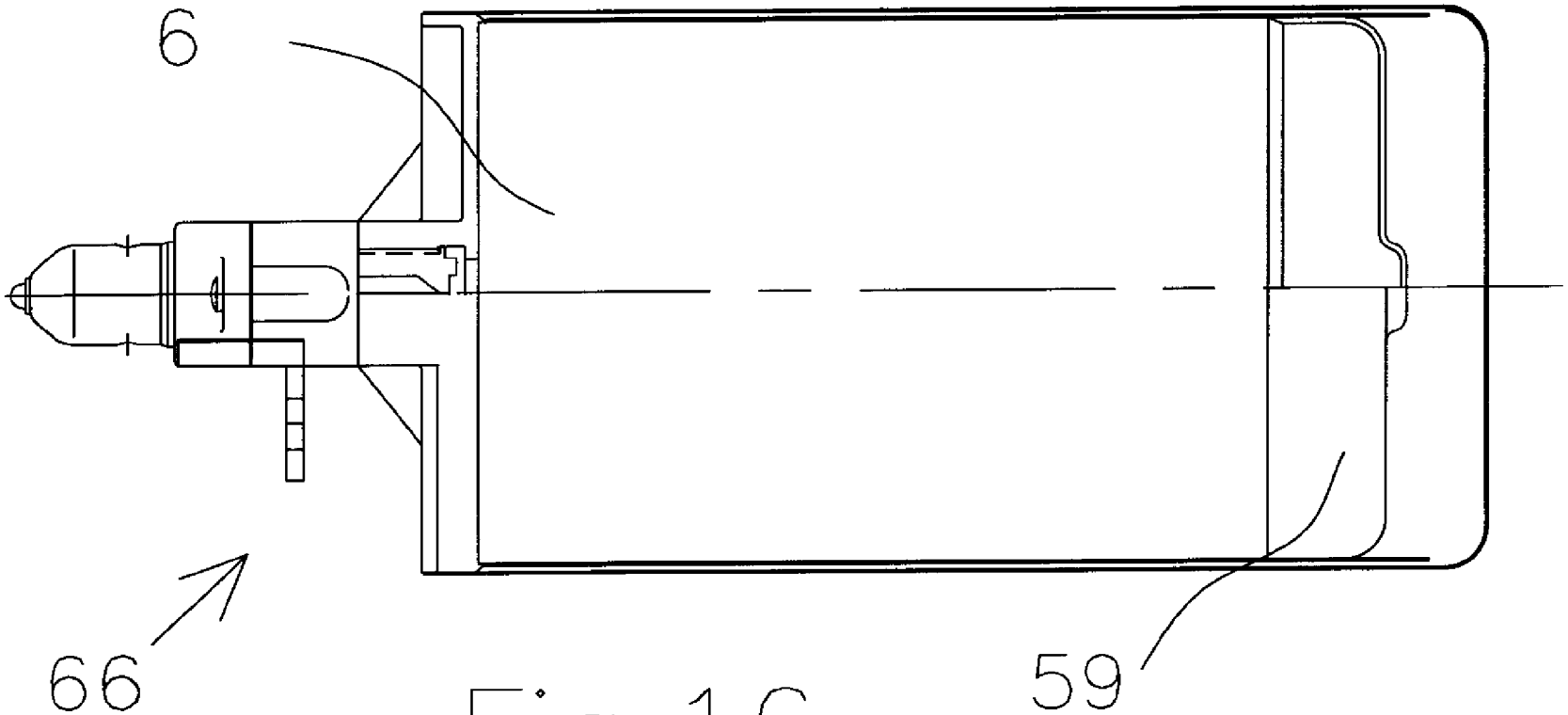
FIG. 16 is a schematic view of a media cartridge equipped with a piston 59 as the movable media containment member.
Figure 17:
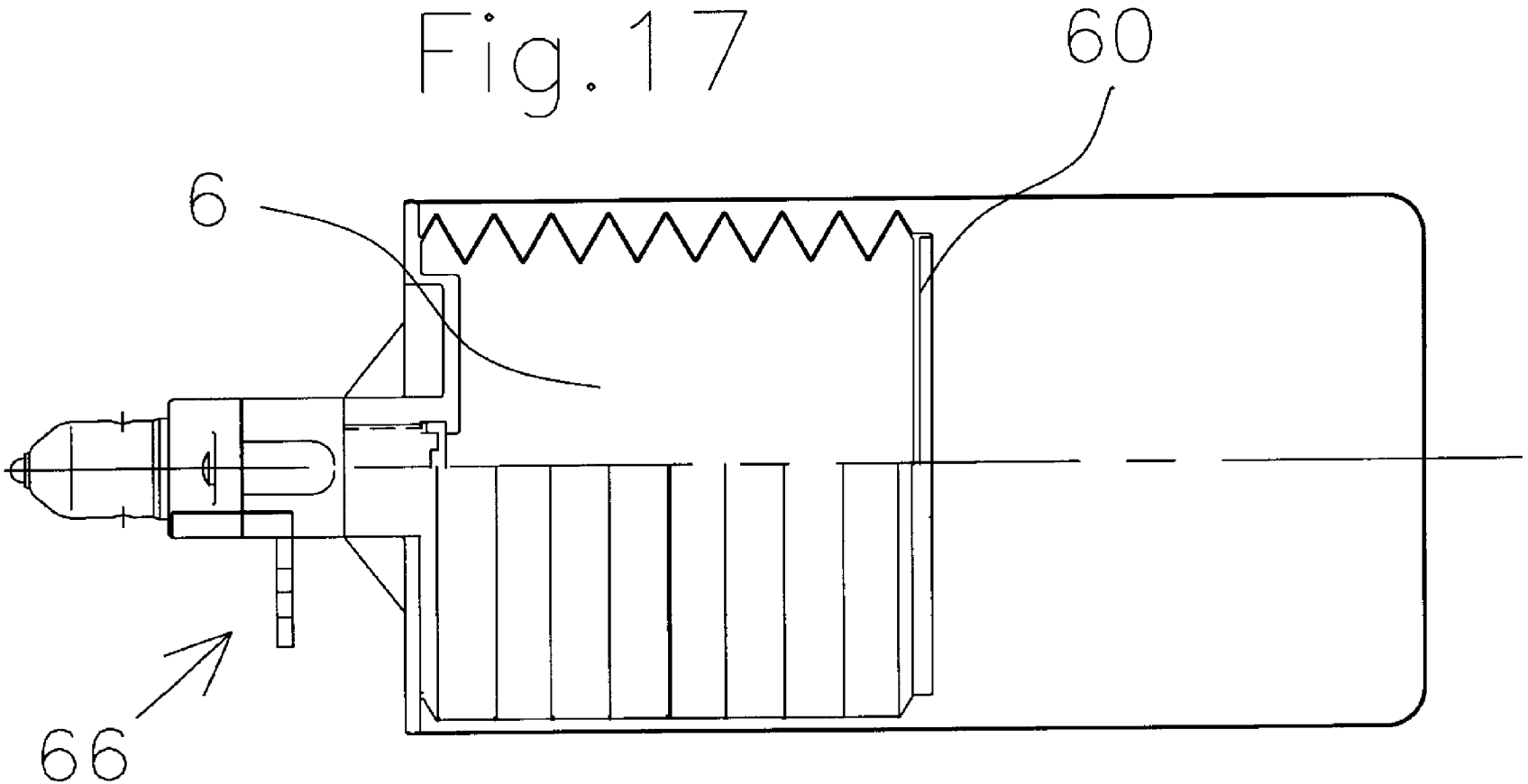
FIG. 17 is a schematic view of a media cartridge equipped with a bellows 60 as the movable media containment member depicts the media as partially expended.
Figure 18:
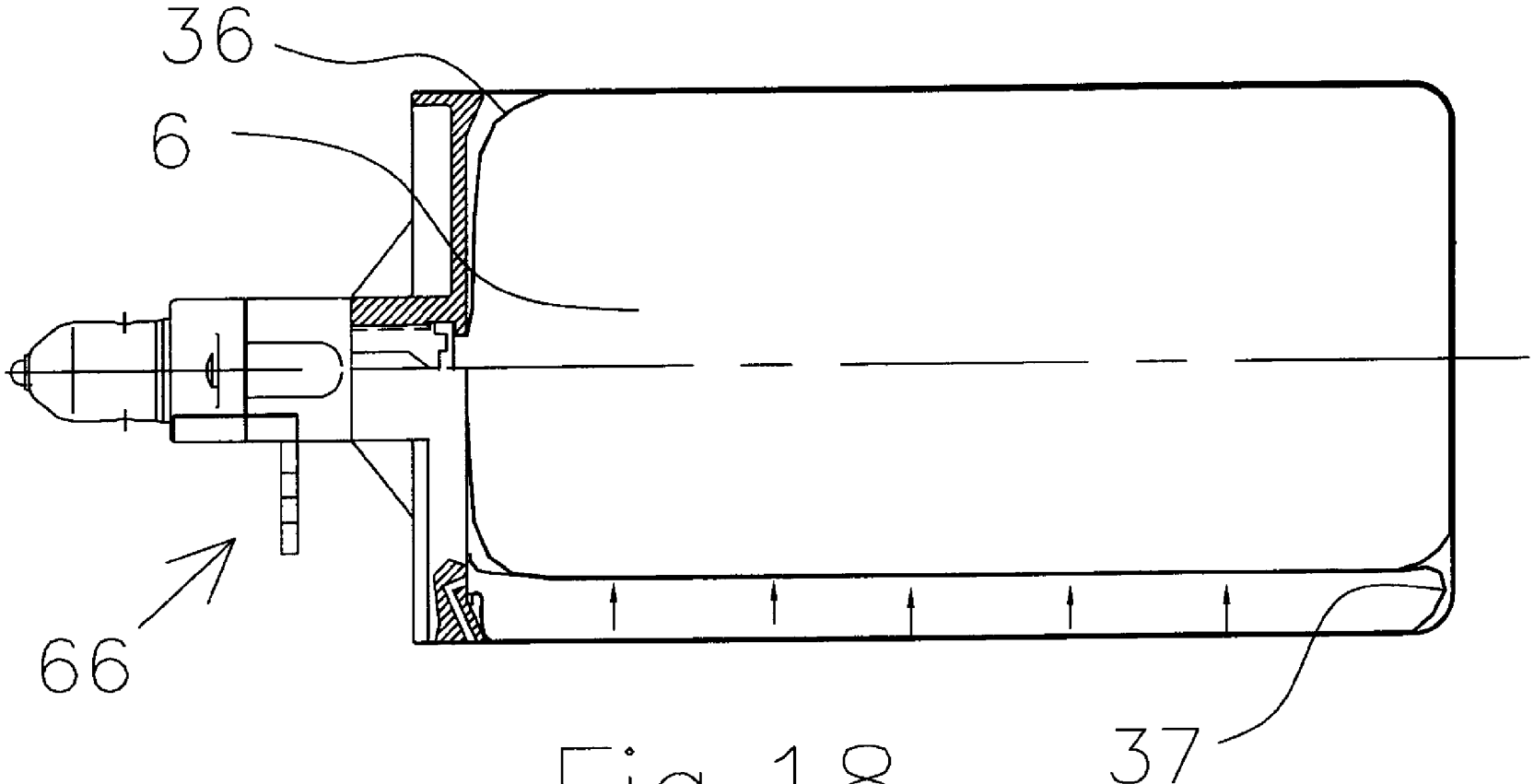
FIG. 18 is a schematic view depicting a media cartridge wherein an air bladder 68 indirectly activates the media containment bladder 36.
Figure 19:
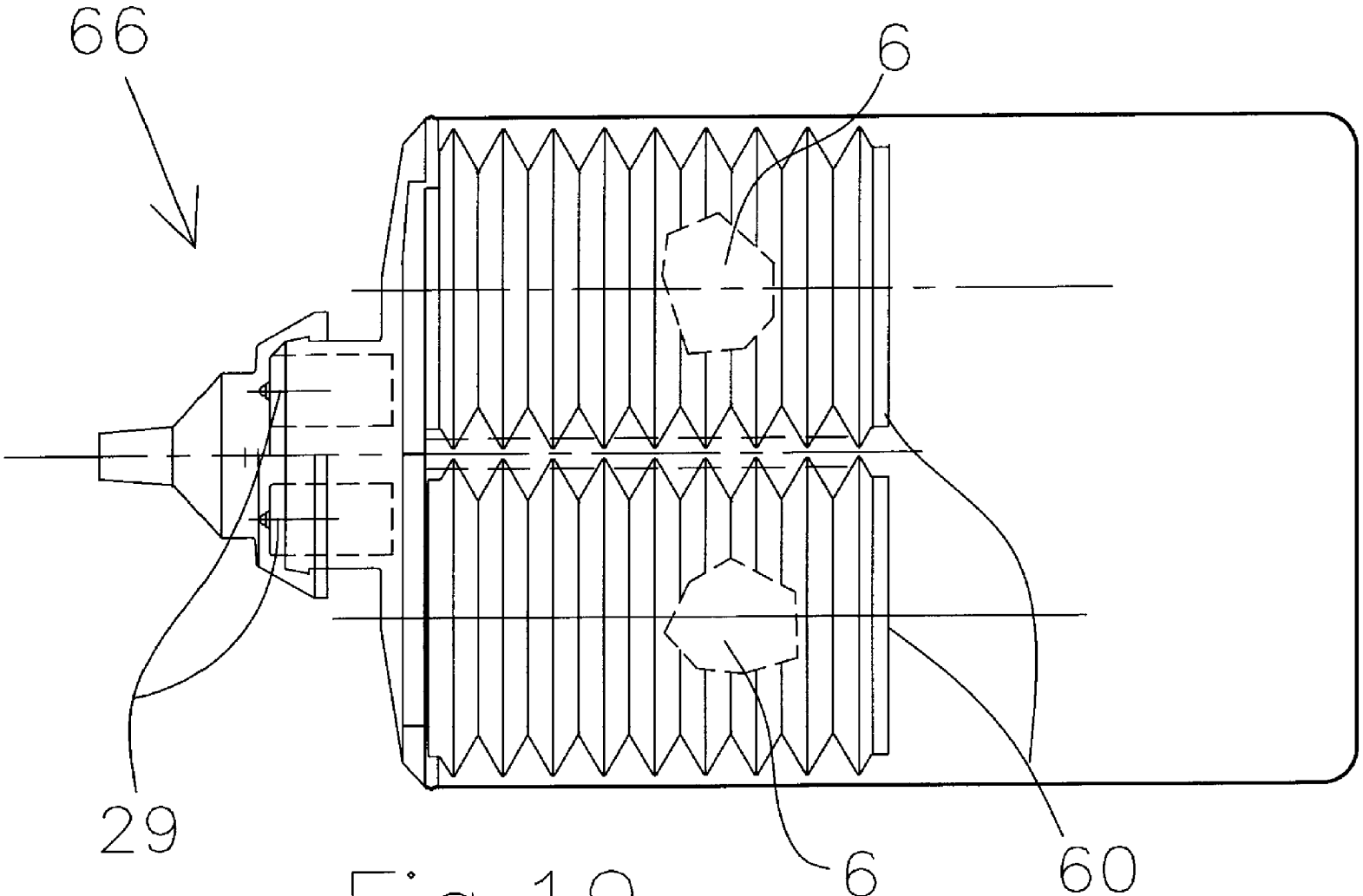
FIG. 19 is a schematic view depicting a media cartridge having two movable media containment members which in this embodiment of the invention are bellows 60. In this embodiment of the invention, there are two media shutoff means 29. In this figure the movable media containment member depicts the media as partially expended.

FIG. 12 is a schematic view of another embodiment of the power sprayer of this invention. In this embodiment of the invention the power sprayer 55 is affixed to a folding power unit handle 3. As illustrated in FIG. 13 the power sprayer 55 can be affixed to a wand 50 (an extension handle) having a handle 51 and a wand trigger 52 to facilitate spraying objects that would ordinarily be difficult to reach. For instance, the wand could be affixed to the power sprayer 50 to spray substrates that ordinarily could not be reached without using a ladder. FIG. 14 is a schematic view that depicts another embodiment of the invention in the form of a ward sprayer 56 wherein an optional pivot arm 53 with a wheel 54 is attached to the power sprayer 55. This embodiment of the invention can be conveniently be used to spray lines on a highway, parking lot, or field.

While certain representative embodiments and details have been shown for the purpose of illustrating the subject invention, it will be apparent to those skilled in this art that various changes and modifications can be made therein without departing from the scope of the subject invention.

What is claimed is:

1. A sprayer which is comprised of a power unit and a media cartridge system, wherein the power unit is comprised of (1) an electrical power source, (2) an electric motor, (3) a pump which is driven by the motor, (4) an electrical control switch, (5) a media cartridge air transfer interface, (6) a media cartridge engagement means, and wherein the media cartridge system is comprised of (a) a media container, (b) a self-cleaning nozzle, (c) a media shut-off means, (d) a primary media atomizing aperture in a configuration relative to the self-cleaning nozzle, (e) a movable media containment member within the media container, (4) a gas transfer interface, and (g) a power unit engagement means which is adapted to provide for temporary attachment to the media cartridge engagement means.

2. A sprayer as specified in claim 1 wherein the pump is a gas pump.

3. A sprayer as specified in claim 1 wherein the sprayer further comprises a constant output control wherein the constant output control provides the electric motor with electricity.

4. A sprayer as specified in claim 1 wherein the output control is an adjustable output control.

5. A sprayer as specified in claim 1 wherein the media cartridge system further comprises an external media supply container.

6. A sprayer as specified in claim 1 wherein the media shut-off means includes a mechanical interference comprising a self cleaning nozzle.

7. A sprayer as specified in claim 1 wherein the movable media containment member is a piston.

8. A sprayer as specified in claim 1 wherein the movable media containment member is a flexible bladder.

9. A sprayer as specified in claim 1 wherein the movable media containment member is a bellows.

10. A sprayer as specified in claim 1 wherein the primary atomization aperture is configured to cause the flow of a primary atomization gas to converge to provide an area of very high turbulence in the media flow path.

11. A sprayer as specified in claim 1 wherein the movable containment member is adapted to provide media flow in response to a force differential provided by gas pressure.

12. A sprayer as specified in claim 11 wherein the force differential is applied directly to the movable media containment member.

13. A sprayer as specified in claim 11 wherein the force differential is applied indirectly through an additional movable fluid containment member.

14. A sprayer as specified in claim 1 wherein at least two movable media containment members are present in the media container.

15. A sprayer as specified in claim 1 wherein the gas transfer interface supplies the primary atomization aperture.

16. A sprayer as specified in claim 15 wherein gas transfer interface additionally supplies enhanced secondary gas.

17. A sprayer as specified in claim 1 which is further comprised of a media preparation device for mixing the media.

18. A sprayer as specified in claim 1 which is further comprised of a power unit electronic interface for cartridge identification and parameter adjustment.

19. A sprayer as specified in claim 1 wherein the primary atomization aperture is configured in a convex shape relative to the media aperture to provide enhanced self-cleaning as well as increased gas flow by entrainment of ambient gases through a coanda effect.

* * * * *